United States Patent [19]

Koenig

[11] 4,131,233

[45] Dec. 26, 1978

[54] SELECTIVELY-CONTROLLED PULSATING WATER SHOWER HEAD

[76] Inventor: Shulamith Koenig, 3 Kadesh Barnea, Tel Aviv, Israel

[21] Appl. No.: 820,328

[22] Filed: Jul. 29, 1977

Related U.S. Application Data

[63] Continuation-in-part of Ser. No. 713,615, Aug. 11, 1976, Pat. No. 4,089,471.

[51] Int. Cl.[2] ..... B05B 3/06

[52] U.S. Cl. ..... 239/381; 239/101; 239/447

[58] Field of Search ..... 239/101, 102, 380–383, 239/389, 443–449, 562, 563; 128/62 A, 66; 401/28

[56] References Cited

U.S. PATENT DOCUMENTS

| | | | |
|---|---|---|---|
| 3,004,719 | 10/1961 | Pouppirt, Jr. | 239/381 |
| 3,403,860 | 10/1968 | Shames et al. | 239/460 |
| 3,736,923 | 6/1973 | Parkison | 128/66 |
| 3,801,019 | 4/1974 | Trenary et al. | 239/383 |
| 3,929,287 | 12/1975 | Givler et al. | 239/449 X |
| 3,967,783 | 7/1976 | Halsted et al. | 239/447 X |
| 4,079,891 | 3/1978 | Kwan | 239/101 |

*Primary Examiner*—Evon C. Blunk
*Assistant Examiner*—Andres Kashnikow
*Attorney, Agent, or Firm*—Benjamin J. Barish

[57] ABSTRACT

A selectively-controlled pulsating water shower head comprises a housing including a spray block formed with a central chamber having a first group of openings for outletting a continuous spray, and an annular chamber therearound having a second group of outlet openings. A plurality of freely movable members, in the form of curved segments, are drivable around the annular chamber by the water inletted into the housing for outletting the water through the second group of openings in the form of a pulsating spray. The shower head further includes a manually-controlled diverter having a displaceable stem assembly for selectively enabling either the continuous spray or the pulsating spray.

10 Claims, 6 Drawing Figures

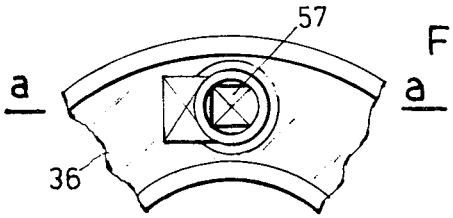
FIG.3
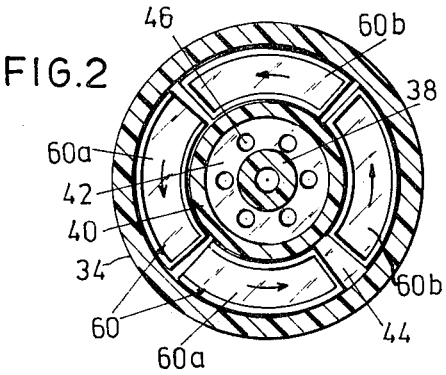
FIG.2
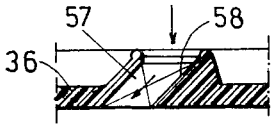
FIG.3a
FIG.4a
FIG.4b
FIG.1
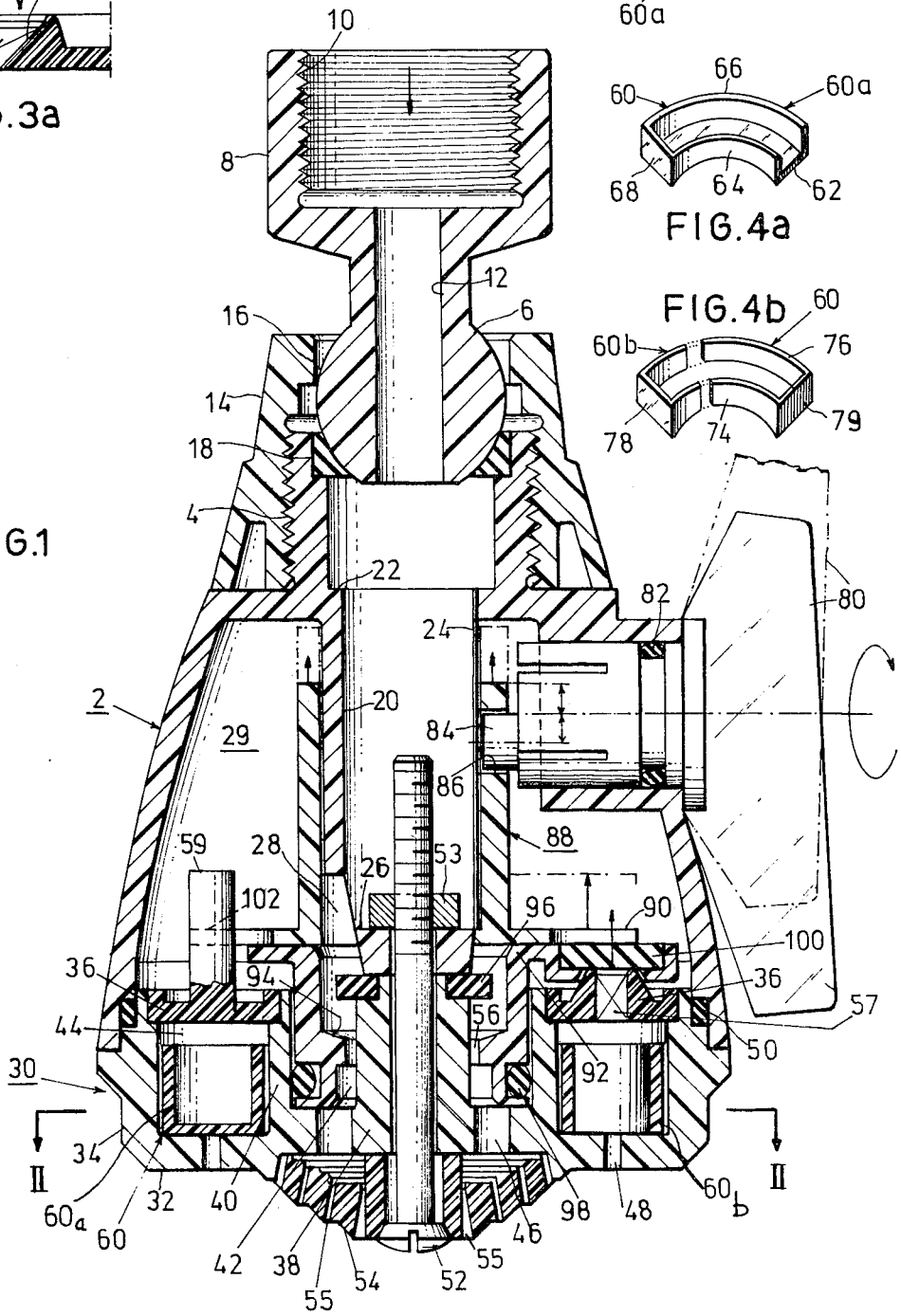

SELECTIVELY-CONTROLLED PULSATING WATER SHOWER HEAD

RELATED APPLICATIONS

The present application is a Continuation-In-Part Application of my copending U.S. Pat. Application Ser. No. 713,615, filed Aug. 11, 1976, now U.S. Pat. No. 4,089,471.

BACKGROUND OF THE INVENTION

The present invention relates to pulsating water shower heads, and particularly to shower heads which may be selectively controlled to produce either a continuous spray or a pulsating spray.

A number of pulsating shower heads are known. These typically include fluid oscillators in the form of valves which may be mechanically actuated to periodically interrupt the flow of liquid. As a rule, the known devices are of complicated construction and are therefore expensive to produce. The above-cited copending U.S. Patent Application Ser. No. 713,615, discloses a pulsating water shower head including movable members, in the form of slidable segments and rollable balls, driven around an annular apertured channel for producing a pulsating effect with respect to the liquid jets exiting from the head.

An object of the present invention is to provide an improved pulsating shower head of the above type, namely including movable members driven around an annular channel or chamber for producing the pulsating effect.

BRIEF SUMMARY OF THE INVENTION

According to the present invention, there is provided a pulsating water shower head comprising a housing having an inlet at its upper end connectable to a supply of water, and a spray block at its lower end. The spray block includes a bottom wall, a top wall, an annular side wall joining the bottom and top walls, and an annular partition wall coaxial with the annular side wall and partitioning the space between same and the top and bottom walls into a central chamber and an annular chamber therearound. The bottom wall of the spray block is formed with a first group of water outlet openings leading from the central chamber, and a second group of water outlet openings leading from the annular chamber. The top wall of the spray block is formed with a first passageway for introducing water into the central chamber, and with a second passageway for introducing water into the annular chamber. A plurality of freely movable members are disposed within the annular chamber and are drivable therearound by the water inletted into the housing, for outletting the water through the second group of openings in the form of a pulsating spray, while the water outletted from the first group of openings is in the form of a continuous spray. The shower head further includes a manually-controlled diverter for selectively opening one of the passageways in the spray block top wall, and closing the other, to selectively enable either the continuous spray or the pulsating spray.

In the preferred embodiment of the invention described below, the freely movable members disposed within the annular chamber include slidable curved segments having a bottom wall conforming to that of the spray block bottom wall, an open top, and a plurality of side and end walls, preferably two curved side walls and only one straight end wall.

The shower head described herein further includes other slidable segments having an open bottom, an open top, a pair of curved side walls, and a pair of straight end walls.

In the preferred embodiment described below, the manually controlled diverter comprises a displaceable stem assembly and a manipulatable member for displacing same either to a first or second position. The stem assembly includes a first valve member closing the first passageway in the spray block top wall when the stem assembly is in its first position and opens the first passageway when the stem assembly is in its second position, and a second valve member which opens the second passageway when the stem assembly is in its first position and closes the second passageway when the stem assembly is in its second position.

Further features and advantages of the invention will be apparent from the description below.

The invention is herein described, by way of example only with reference to the accompanying drawings, wherein:

FIG. 1 is a vertical section of one form of pulsating shower head constructed in accordance with the invention, the parts being shown in the pulsating-jet-disabling position in full lines, and in the pulsating-jet-enabling position in broken lines;

FIG. 2 is a reduced transverse sectional view along lines II—II of FIG. 1;

FIG. 3 is a fragmentary view illustrating the inlet opening to the pulsating chamber in the shower head of FIG. 1;

FIG. 3*a* is a sectional view along lines a—a of FIG. 3; and

FIGS. 4*a* and 4*b* are three-dimensional views illustrating the two types of slidable segments used in the shower head for producing the pulsating effect.

DESCRIPTION OF THE PREFERRED EMBODIMENT

The pulsating shower head illustrated in the drawings comprises a housing, generally designated 2, of frustoconical shape pivotably mounted at its upper end 4 to a ball joint 6 carried by a fitting 8 serving as the inlet connectable to the water supply pipe (not shown) by means of internal screw threads 10. Ball joint 6 is formed with an axial bore 12 for the water, and is attached to the shower head housing 2 by means of a collar 14 threaded at its lower end to the housing, and formed at its upper end with a reduced-diameter neck 16 for receiving the ball joint 6. The upper end 4 of housing 2 includes an annular gasket 18 sealingly engageable with the outer surface of ball 6.

Housing 2 is formed with a re-entrant sleeve 20 of rectangular section open at its upper end 22 to communicate with bore 12 of ball joint 6. Sleeve 20 is substantially cylindrical in shape, except that it is formed with an elongated slot 24 at one side (right, FIG. 1), and its bottom is closed by a rectangular cross-bar 26 of substantially rectangular-configuration formed with an opening through its centre, there being a space 28 between the cross-bar and the lower end of sleeve 20. Space 28 provides communication between the interior of sleeve 20 and an internal chamber 29 formed within housing 2.

A spray block, generally designated 30, closes the lower end of housing 2. Spray block 30 includes a bottom wall 32, an annular side wall 34 integrally formed therewith, and a top wall 36 attached to side wall 34 by a snap-fit. Bottom wall 32 of the spray block 30 further includes a central post 38 and an annular partition wall 40 between the post and the outer side wall 34. The partition wall divides the spray block into a central chamber 42 and an annular chamber 44 therearound. Bottom wall 32 of the spray block further includes a first group of water outlet openings 46 leading from the central chamber 42, and a second group of outlet openings 48 leading from the annular chamber 44.

The spray block 30 is attached to the lower end of housing 2 by a press-fit, there being a sealing ring 50 interposed between the spray block and the lower end of the housing. The spray block is held within the housing by pin 52 passing through the centre of its bottom plate 32 and the opening in the rectangular cross-bar 26 of sleeve 20, the pin being secured within the sleeve by a nut 53. Pin 52 further secures an apertured cap 54 to the bottom wall 32 of the spray block, cap 54 having a plurality of annular arrays of openings 55 aligned with openings 46 of the spray block.

The top plate 36 of the spray block 30 is formed with an enlarged central opening 56 which serves as a first passageway for introducing water into the central chamber 42, and is further formed with an eccentric opening 57 which serves as a second passageway for introducing water into the annular chamber 44. The latter opening 57 is formed with a deflector surface 58 (FIG. 3*a*) having an angle of about 50° to produce a swirl to the water introduced into the annular chamber 44. In addition, the upper surface of the top wall 36 is formed with an axially extending pin 59 for a purpose to be described below.

Disposed within annular chamber 44 are a plurality of freely movable members 60 which are driven around the chamber by the water inletted through passageway 57. As these elements are driven around annular chamber 44, they interrupt its outlet openings 48 and thereby produce a pulsating effect with respect to the water spray or jets outletted through those openings.

These freely movable members 60 driven around the annular chamber 44 are more particularly illustrated in FIGS. 2, 4*a* and 4*b*. They are constituted of four slidable curved segments of two types, namely two segments **60*a*** of the type illustrated in FIG. 4*a*, and two segments **60*b*** of the type illustrated in FIG. 4*b*. The segments **60*a*** (FIG. 4*a*) each includes a bottom wall 62 having a flat face conforming to the face of the bottom of annular channel 44, an open top, a pair of curved side walls 64, 66, and a straight end wall 68 at one end, the opposite end of the segments being open. In segments **60*b*** (FIG. 4*b*), both the bottom and top walls are open, each segment being constituted of two curved side walls 74, 76, and two straight end walls 78, 79. The four segments 60 included within the annular chamber 44 extend substantially the complete circumference of the chamber, so that each segment defines an arc of approximately 90°.

Segments **60*a* serve as the interrupting or chopping segments, since the bottom wall 62 of each segment, as it sweeps along the bottom of chamber 44, continuously interrupts and opens the outlet openings 48 to produce a pulsating effect with respect to the water jets outletted through those openings. Since the bottom walls of segments 60*b* are open, these segments produce very little pulsating effect and are provided to fill in the space of the chamber 44, thereby producing a smoother and quieter operation, and to aid in driving segments 60*a* by the water introduced via opening 57 into chamber 44**.

It will thus be seen that the water inletted through passageway 57 into the annular chamber 44 will be outletted in the form of a pulsating spray or jet; whereas the water inletted through central passageway 56 into the central chamber 42 will be outletted through openings 46 and 55 in the form of a continuous spray or jet.

The shower head illustrated in the drawings includes a manually-controlled diverter for selectively opening either passageway 56 or 57 for selectively enabling either the continuous spray or the pulsating spray. The diverter includes a rotatable knob 80 snap-fitted into an opening formed in the shower head housing 2 and sealed from its interior by an O-ring 82. The inner end of knob 80 is formed with an eccentric pin 84 received within an opening 86 formed in a stem assembly, generally designated 88, such that rotation of knob 80 raises and lowers the stem assembly with respect to the spray block 30 at the lower end of the shower housing 2.

Stem assembly 88 is movable within housing sleeve 20 and is displaceable by the rotation of knob 80 to one of two positions, to selectively enable either the continuous spray or the pulsating spray from the shower head.

More particularly, stem assembly 88 is formed with a circular flange 90 which is rigidly secured to the upper end of a valve plate 92 formed with a central valve seat 94. The latter cooperates with a sealing ring 96 secured to the upper end of central post 38 by means of the rectangular cross-bar 26 at the bottom of housing sleeve 20, which cross-bar is pressed against the upper face of sealing ring 96 when the spray block 30 is firmly secured to the housing by threaded pin 52. It will be seen that when stem assembly 88 is raised by knob 80, its valve seat 94 is lifted to engage the underside of sealing ring 96 to thereby close the passageway 56 leading into the central chamber 42.

An O-ring 98 is received on the outer surface of valve plate 92 for sealing same with respect to central chamber 42 during the displacement of the valve assembly 88 by rotary knob 80.

The circular flange 90, particularly the portion of the valve plate 92 underlying it, carries a second valve member in the form of a sealing disc 100 which is adapted, when the stem assembly 88 is raised, to open the passageway 57 leading into the annular chamber 44, and when the stem assembly 88 is lowered, to close that passageway. In addition, the opposite side of circular flange 90 is formed with a slot or opening 102 through which extends the pin 59 carried by the upper wall 36 of the spray block 30, for guiding the vertical displacement of the stem assembly 88 during the rotation of knob 80.

The water shower head operates as follows:

When it is desired to have a continuous spray of water to issue from the shower head, knob 80 is rotated to bring the stem assembly 88 to its lowermost position, as illustrated in full lines in FIG. 1. In this position, valve seat 94 of the stem assembly is spaced below the sealing ring 96, so that the water introduced (via sleeve 20 and space 28) into chamber 29 of the shower head may pass into the central chamber 42 of the spray block 30 and out through openings 46 in the form of a continuous spray. During this position of the stem assembly 88, its valve disc 100 is seated against opening 57, blocking the water from entering the annular chamber 44, thereby disabling the pulsating spray.

When it is desired to have a pulsating spray, knob 80 is rotated to lift the stem assembly 88 to the broken-line position illustrated in FIG. 1. In this position, valve seat 94 is pressed against the lower face of sealing 96, thereby interrupting the flow of the water into the central chamber 42 of the spray block 30, so that no water issues from the continuous-spray outlet openings 46. Also, when the stem assembly 88 is in this upper position, its sealing disc 100 is spaced upwardly away from opening 57, thereby permitting the water to enter the annular chamber 44 of the spray block. This water is given a swirl by the deflector 58 in the passageway communicating with opening 57, thereby driving the curved segments 60 around the annular chamber 44. The segments 60*a* including the bottom walls 62, which successively open and close the openings 48, produce a pulsating effect to the water outletted through these openings. Segments 60*b*, which have open tops and bottoms but only closed side and end walls, produce very little pulsating effect in the spray issuing from the outlet openings 48, and are provided mostly for fill-in and for drive purposes, producing a smoother, quieter operation as mentioned above. It will thus be seen that in this lowered position of the stem assembly 88, the continuous spray via openings 46 is disabled, and the pulsating spray via openings 48 is enabled.

While the described embodiment illustrates the use of the two types of slidable segments 60, it will be appreciated that only the one type (60*a*) including the closed bottom wall could be used, as it is this type which mainly produces the pulsating effect. In addition, while four such segments are illustrated in the described embodiment, fewer or more segments could be used as desired for any particular application.

Many other variations, modifications and applications of the illustrated embodiment of the invention will be apparent.

What is claimed is:

1. A pulsating water shower head, comprising: a housing having an inlet connectable at its upper end to a supply of water; a spray block at the lower end of the housing; said spray block including a bottom wall, a top wall, an annular side wall joining the bottom and top walls, and an annular partition wall coaxial with said annular side wall and partitioning the space between same and the top and bottom walls into a central chamber and an annular chamber therearound; said spray block bottom wall being formed with a first group of water outlet openings leading from said central chamber, and a second group of water outlet openings leading from said annular chamber; said spray block top wall being formed with a first passageway for introducing water into said central chamber, and a second passageway for introducing water into said annular chamber; a plurality of freely movable members disposed within said annular chamber and drivable therearound by the water inletted into the housing, for ouletting the water through said second group of openings in the form of a pulsating spray, while the water outletted through the first group of openings is in the form of a continuous spray; and a manually-controlled diverter for selectively opening one of said passageways in the spray block top wall and closing the other to selectively enable either the continuous spray or the pulsating spray to be outletted from the lower head.

2. A shower head according to claim 1, wherein said freely movable members disposed within said annular chamber include slidable curved segments having a bottom wall face conforming to that of the spray block bottom wall, an open top, and a plurality of side and end walls.

3. A shower head according to claim 2, wherein said side and end walls of the latter slidable segments are constituted of a pair of curved side walls and only one end wall.

4. A shower head according to claim 2, wherein said freely movable members disposed within said annular chamber further include other slidable segments having an open bottom, an open top, a pair of curved side walls, and a pair of straight end walls.

5. A shower head according to claim 1, wherein said manually controlled diverter comprises a displaceable stem assembly and a manipulatable member for displacing same either to a first position or to a second position, said stem assembly including a first valve member closing said first passageway when the stem assembly is in said first position and opening said first passageway when the stem assembly is in said second position, and a second valve member opening said second passageway when the stem assembly is in said first position and closing said second passageway when the stem assembly is in said second position.

6. A shower head according to claim 5, wherein said displaceable stem assembly comprises an outer circular flange extending transversely thereof parallel to said top wall of the spray block, said second valve member being a circular disc carried by said flange in alignment with said second passageway of the spray block top wall.

7. A shower head according to claim 6, wherein said top wall of the spray block includes an axially extending pin receivable in an opening in said circular flange of the stem assembly for guiding the displacement thereof.

8. A shower head according to claim 5, wherein said bottom wall of the spray block further includes a centre post having a sealing ring at its upper end, said first valve member of the stem assembly being constituted of a valve seat movable into engagement with said sealing ring when the stem assembly is displaced to its first position, and movable out of engagement from said sealing ring when the stem assembly is displaced to its second position.

9. A shower head according to claim 8, further including a pin passing through the centre of the spray block bottom wall and said centre post and threaded onto said housing, and a cross-bar carried by said housing and engageable with said sealing ring for securely holding same at the upper end of said centre post when the pin is fully threaded into said housing.

10. A shower head according to claim 5, wherein said manipulatable member of the diverter is a rotatable knob having an eccentric pin receivable in an opening in said displaceable stem assembly.

* * * * *